United States Patent [19]

McNamee

[11] Patent Number: 4,566,129

[45] Date of Patent: Jan. 21, 1986

[54] RESEALABLE BAG AND TAMPER PROOF SEALING RING

[76] Inventor: Douglas D. McNamee, 8804 Bluff La., Fair Oaks, Calif. 95628

[21] Appl. No.: 563,725

[22] Filed: Dec. 21, 1983

[51] Int. Cl.[4] ..... B65D 33/14

[52] U.S. Cl. ..... 383/5; 206/806; 383/78

[58] Field of Search ..... 383/5, 68, 78, 98, 99, 383/84, 86, 89, 91, 79, 81-83; 229/76, 84, 79, 78 A; 206/806

[56] References Cited

U.S. PATENT DOCUMENTS

| | | | |
|---|---|---|---|
| 526,799 | 10/1894 | Barnard | 229/76 |
| 606,366 | 6/1898 | Southard | 383/78 |
| 1,767,770 | 6/1930 | Olsen | 383/5 |
| 2,051,106 | 8/1936 | Rosen | 383/83 |
| 2,188,039 | 1/1940 | Farmer | 383/78 |
| 2,475,236 | 7/1949 | Gollub | 383/84 |
| 2,810,510 | 10/1957 | Korn | 383/78 X |
| 2,843,309 | 7/1958 | Wheeler | 383/5 |
| 3,545,668 | 12/1970 | Hultberg . | |
| 3,727,829 | 4/1973 | Huni | 383/86 X |
| 3,865,304 | 2/1975 | Mojonnier et al. | 383/82 |
| 4,117,934 | 10/1978 | Mowli et al. . | |
| 4,261,506 | 4/1981 | Scott . | |
| 4,356,954 | 11/1982 | Mojonnier . | |

FOREIGN PATENT DOCUMENTS

| | | | |
|---|---|---|---|
| 0619815 | 3/1949 | United Kingdom | 383/84 |

*Primary Examiner*—Allen N. Shoap
*Assistant Examiner*—Bryon Gehman
*Attorney, Agent, or Firm*—Henderson & Sturm

[57] ABSTRACT

This invention relates to a resealable bag apparatus (10) having front (13) and rear (14) bag panels that are releasably secured together by a pair of enclosure arms (18, 19) that are in turn releasably secured by a flap member (26), and the apparatus is further provided with a tamper proof sealing unit (100) that extends from the rear face to the front face of the apparatus (10) thru a suspension aperture (27).

1 Claim, 9 Drawing Figures

FIG. 1.
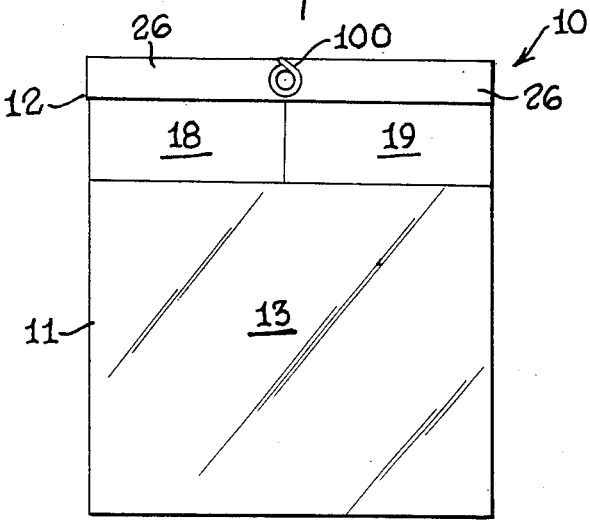
FIG. 2.
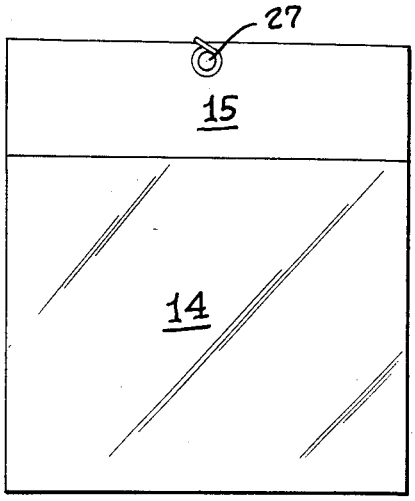
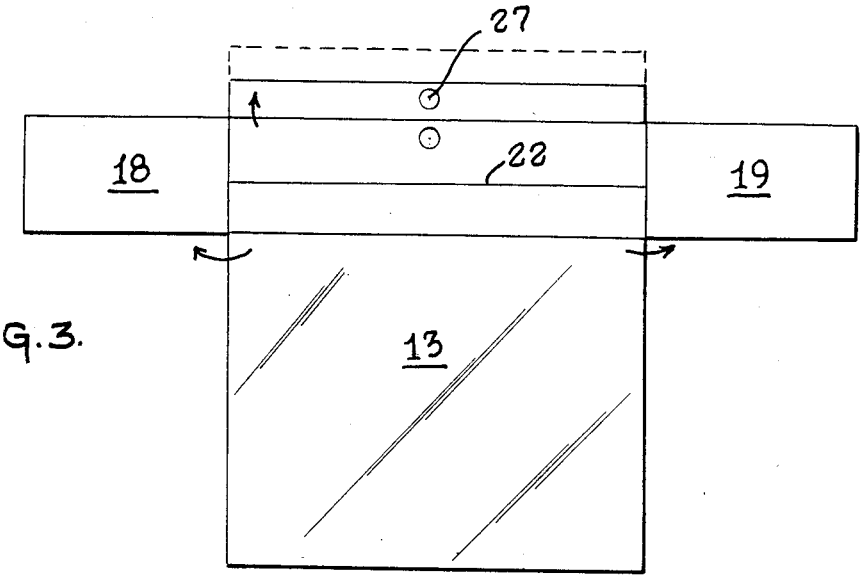
FIG. 3.
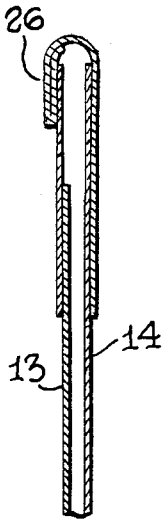
FIG. 4.
FIG. 5.
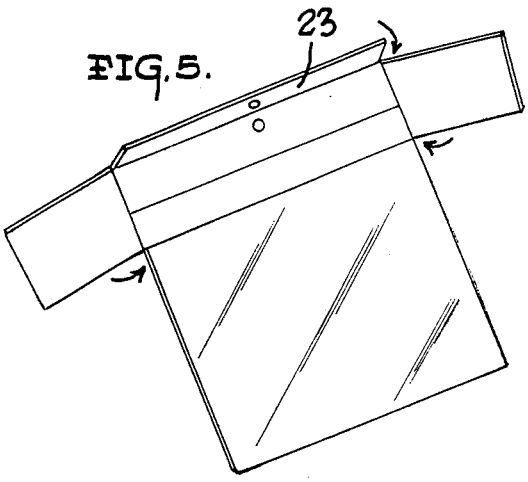
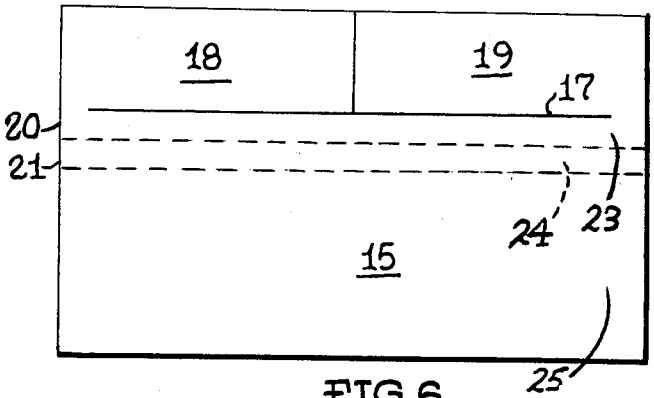
FIG. 6.

RESEALABLE BAG AND TAMPER PROOF SEALING RING

TECHNICAL FIELD

This invention relates generally to resealable bags, receptacles, packages, or the like, having a tamper proof seal.

BACKGROUND ART

There have been many attempts in the past to devise a resealable closure arrangement for bags, packages, etc., wherein a portion of the contents of the bag could be removed, and then the closure could be resealed to retain the freshness of the remaining portion of the contents.

Many prior art devices employ a stiffening member that cooperates with the closure opening, or the sides of the receptacle to effect the sealing thereof.

Other prior art devices rely upon the stiffness of the bag material to effect the resealing of the closure.

These prior art devices while adequate for their intended purpose, are limited in their functional scope, utility and modes of alternate use, as well as limiting access to the interior of the bag or receptacle.

Examples of some of these prior art devices may be seen by reference to U.S. Pat. Nos. 4,261,506; 4,356,954; 3,545,668 and 4,117,934.

DISCLOSURE OF THE INVENTION

The above stated deficiencies are substantially resolved by virtue of the unique cooperation between the bag panels and the closure element that allow the bag to be suspended from the closure element, and wherein the closure element is releasably sealed upon itself and upon opposed bag surfaces.

The closure element furthermore is both permanently and releasable secured to various portions of the bag, with the rear bag panel being permanently secured, and the front bag panel being releasably secured by a pair of arms that are formed on the closure element.

Both the upper portion of the bag and the major portion of the closure element are stamped with a ribbed or fluted design, that is not only attractive, but also necessary to maintain the cooperating portions of the bag and closure element in sealing engagement.

The unique design of the closure element is further adapted to provide reinforced portion at the location that the closure element is folded upon itself. This reinforced portion not only functions to retain the releasable sealed arms in position, but also provides a double thickness of material that is punched, to produce an aperture from which the bag assembly may be suspended.

In addition to the aforementioned structure, the resealable bag is also provided with a tamper proof ring sealing element, that will indicate whether the bag has been opened prior to purchase. The ring sealing element comprises a spiral, frangible sealing member that extends from the back of the bag to the front of the bag thru the suspension aperture. Any attempt to open the bag prior to purchase will cause the ring material to operate thereby warning subsequent purchasers that the contents of the bag may have been contaminated.

While there are two distinct ways that the closure element may be constructed to arrive at the final configuration, the cooperation of the various portions of the closure element and the bag will remain virtually the same.

BRIEF DESCRIPTION OF THE DRAWINGS

These and other attributes of the invention will become more clear upon a thorough study of the following description of the best mode for carrying out the invention, particularly when reviewed in conjunction with the drawings, wherein FIG. 1 is a front elevational view of the sealed apparatus.

FIG. 2 is a rear elevation view of the apparatus in its sealed position.

FIG. 3 is a front elevation view of the apparatus in its unsealed position.

FIG. 4 is a cross sectional view of the apparatus.

FIG. 5 is a perspective view illustrating the folding cooperation of the various portions of the closure element.

FIG. 6 is a detail view of the closure element prior to attachment to the bag.

BEST MODE FOR CARRYING OUT THE INVENTION

Figure 7:
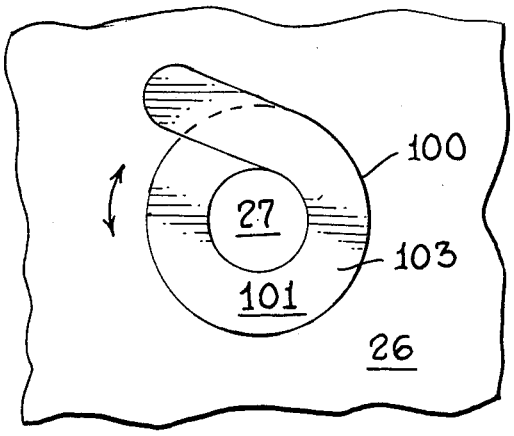
FIG. 7 is an enlarged detail view of the front face of the tamper proof sealing unit.

Referring now to the drawings, and in particular to FIG. 1, the apparatus may be seen as depicted generally by the numeral 10. The apparatus (10) includes a bag unit (11) and a closure element unit (12) and a tamper proof sealing unit (100). Each of these units will now be described in seriatim fashion.

The bag unit (11) includes a front panel (13) and a rear panel (14). The transparent panels (13, 14) may be formed of any material normally employed in the fabrication of bags, such as paper cellophane, plastic, etc., and the particular material chosen is not considered to form part of this invention. Furthermore, the bag unit (11) may be fabricated from a single sheet of material, wherein the material is folded back upon itself, and the opposed sides are joined together by means of heat adhesives, etc. The bag unit may also be fabricated from two separate sheets of material, wherein the bottom and sides of the opposed sheets are attached or sealed together to form an open ended enclosure.

While the particular means of fabricating the bag unit (11) is not considered to form part of this invention, the relative lengths of the front (13) and rear (14) panels considered to be crucial thereto. As can be seen by reference to FIGS. 3 and 4 the rear panel (14) of the bag unit (11) is substantially longer than the front panel (13). The specific reason, for this disparity in length, will become readily apparent further on in the specification.

The closure element unit (12) may be comprised of a single sheet of material such as paper, or the like that is cut, scored and folded. As can best be seen by reference to FIG. 6, the preferred construction of the closure element unit (12) involves a generally rectangular sheet (15) of paper or the like; that is provided with a vertical slit (16) extending from the midpoint of its upper edge to a point approximately ⅓ down the sheet. The vertical slit (16) intersects and terminates at an elongated horizontally disposed slit (17) that extends across the rectangular sheet (15), but is spaced from the sides thereof. As can be seen in the drawings, the vertical (16) and horizontal (17) slit create two enclosure arms (18) and (19), whose purpose and function will be described shortly.

In addition to the aforementioned structure, the sheet of paper (15) is also provided with an out-board end 15' and a pair of horizontal fold lines (20) and (21) (shown as dashed lines) which extend entirely across the width of the sheet (15). The fold lines (20, 21) are formed proximate to the centerline of the sheet, and the first fold line (20) is spaced from the horizontal slit (17) a distance equal to the distance between the fold lines.

As mentioned previously, the horizontal and vertical slits create the enclosure arms 18 and 19. These arms (18, 19) are coated with a pressure sensitive adhesive and form the primary closure means for resealing the bag opening (22). The portion of the sheet (15) defined by the horizontal slit (17) and the first fold line 20 forms the interior flap surface (23) of the closure. The portion of the sheet (15) defined by the first and second fold lines (20, 21) forms the exterior flap surface (24) of the closure, and the portion of the sheet (15) below the second (21) fold line forms the primary bag attachment surface (25).

The bag unit (11) and the closure element unit (12) are joined together in the following manner: The rear panel (14) of the bag is fixedly secured to the bag attachment surface (25) and the enclosure arms (18, 19) are fixedly secured together. The next to the last step in the fabrication of the apparatus is to impress a ribbed or fluted pattern (50) into the closure element (12) and the portions of the bag (11) that it encompasses. As in other instances hereto described, the particular means used to impress the ribbed pattern is not considered to form part of this invention. The last step in the fabrication of the apparatus required that the flap member (26), formed by the joining of the interior (23) and exterior (24) flap portions, be folded downwardly, and coated with a pressure sensitive adhesive and brought into releasable engagement with the enclosure arms (18, 19); whereupon an aperture (27) is punched through the combined thickness of the flap member (26), the rear bag panel (14) and the bag attachment surface (25).

Figure 9:
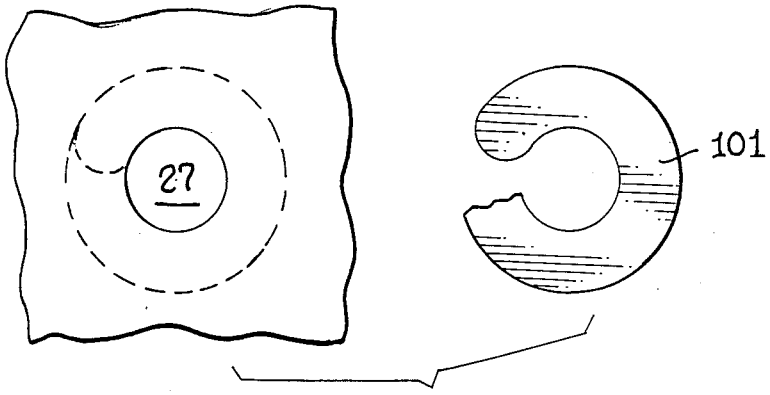
FIG. 9 is an illustration of how the tamper proof sealing unit might separate due to tampering.
Figure 8:
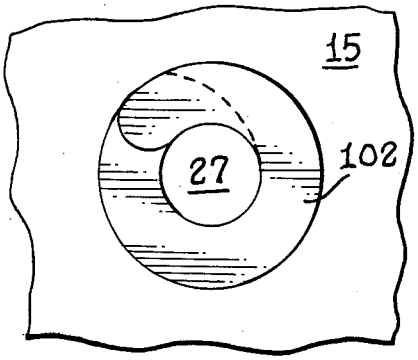
FIG. 8 is an enlarged detail view of the rear face of the tamper proof sealing unit.

Once the aperture (27) has been formed, the tamper proof sealing unit (100) may be attached to the resealable bag assembly (10). As can best be seen by reference to FIGS. 7 thru 9, the tamper proof sealing unit (100) comprises a spiral strip of frangible material (101). As shown in FIG. 8, a portion of the material is folded upon itself and secured together to form a ring element (102) which is secured to the rear face of the bag assembly (10). The remaining length of the material (101) is passed through the aperture (27) to form another ring element (103) on the front face of the bag assembly. The ring element (103) is likewise secured to the front face of the bag assembly, and its free end forms a tear tab (104) to facilitate the removal of the tamper proof sealing unit by a purchaser.

In as much as the frangible strip (101) is secured to both the front and rear face of the bag assembly thru the aperture (27), the contents of the bag cannot be disturbed without fracturing the frangible strip. If the strip is not integral, the potential purchaser is therefore put on notice that the contents may be contaminated.

As can best be seen by reference to FIGS. 3 and 4, the front panel (13) of the bag defines the bag opening (22) and the top of the front panel is disposed at approximately the same level of the midpoint of the enclosure arms (18 and 19).

It should be appreciated at this juncture, that the flap member (26) forms the secondary sealing means that retains the enclosure arms (18, 19) in their sealed relationship. To open the bag assembly, the flap member (26) is lifted up and out of engagement with the enclosure arms (18) and (19). The enclosure arms which are in releasable sealing engagement with both the front (13) and rear (14) bag panels, are pulled away from engagement with those surfaces, and the contents of the bag can then be removed.

The resealing operation is illustrated in FIG. 5, and comprises the steps of: replacing the enclosure arms (18) and (19) into engagement with the front (13) and rear (14) bag panels; and then folding the flap member (26) downwardly into engagement with the enclosure arms (18) and (19) to retain them in their sealed relationship.

Obviously, many modifications and variations of the present invention are possible in light of the above teachings. It is, therefore, to be understood that, within the scope of the appended claims the invention may be practiced otherwise than as specifically described.

I claim:

1. A tamper proof sealing element for use in conjunction with a bag assembly, wherein the bag assembly comprises front and rear bag panels secured together by a closure element, and having an aperture extending through the closure element and at least one of said front and rear bag panels, wherein the tamper proof sealing element comprises;

an elongated spirally wound strip extending through said suspension aperture and secured in a generally circular fashion to both the front and rear faces of the bag assembly.

* * * * *